US009534396B2

(12) United States Patent
Castonguay et al.

(10) Patent No.: US 9,534,396 B2
(45) Date of Patent: Jan. 3, 2017

(54) ARTIFICIAL FLAGSTONE FOR PROVIDING A SURFACE WITH A NATURAL RANDOM LOOK

(71) Applicant: Oldcastle Building Products Canada, Inc., St-John (CA)

(72) Inventors: Bertin Castonguay, Magog (CA); Marcel Thomassen, L'Epiphanie (CA)

(73) Assignee: Oldcastle Building Products Canada, Inc. (CA)

( * ) Notice: Subject to any disclaimer, the term of this patent is extended or adjusted under 35 U.S.C. 154(b) by 0 days.

(21) Appl. No.: 14/948,527

(22) Filed: Nov. 23, 2015

(65) Prior Publication Data

US 2016/0076256 A1 Mar. 17, 2016

Related U.S. Application Data

(63) Continuation of application No. 14/577,856, filed on Dec. 19, 2014, now Pat. No. 9,193,215, which is a (Continued)

(51) Int. Cl.
*E01C 5/06* (2006.01)
*E04F 13/08* (2006.01)

(Continued)

(52) U.S. Cl.
CPC ..... *E04F 13/0873* (2013.01); *B44F 9/04* (2013.01); *E01C 5/00* (2013.01); *E01C 5/06* (2013.01);

(Continued)

(58) Field of Classification Search
CPC ..... E04F 13/0873; E04F 15/08; E01C 5/06; B44F 9/04

(Continued)

(56) References Cited

U.S. PATENT DOCUMENTS 653,515 A 7/1900 Kennedy
815,547 A 3/1906 Messmore (Continued)

FOREIGN PATENT DOCUMENTS

BE 570711 11/1961
CA 1150553 7/1983

(Continued)

OTHER PUBLICATIONS

Lawrence, Backyard Brickwork, 1989, p. 76, Garden Way Publishing, Pownal, VT, U.S.A.

(Continued)

*Primary Examiner* — Raymond W Addie
(74) *Attorney, Agent, or Firm* — Kilpatrick Townsend & Stockton LLP

(57) ABSTRACT

An artificial flagstone for use in combination with other similar flagstones for covering a surface with a natural random look, the flagstone having a generally hexagonal body comprising a first, second, third, fourth, fifth and sixth consecutive vertices; a first pair of first and second sides extending radially from the first vertex; a second pair of third and fourth sides extending radially from the third vertex; a third pair of fifth and sixth sides extending radially from the fifth vertex; wherein the sides of at least one of the first, second and third pair of sides have at least one split deviation along their length and are respectively rotational images of each other, and the artificial flagstone has no rotational symmetry when rotated about a central axis.

11 Claims, 11 Drawing Sheets

Related U.S. Application Data continuation of application No. 14/272,371, filed on May 7, 2014, now Pat. No. 8,967,907, which is a continuation of application No. 13/906,116, filed on May 30, 2013, now Pat. No. 8,747,019, which is a continuation of application No. 13/619,606, filed on Sep. 14, 2012, now Pat. No. 8,500,361, which is a continuation of application No. 13/367,117, filed on Dec. 6, 2012, now Pat. No. 8,337,116, which is a continuation of application No. 13/167,053, filed on Jun. 23, 2011, now Pat. No. 8,132,981, which is a continuation of application No. 12/729,909, filed on Mar. 23, 2010, now Pat. No. 7,988,382, which is a continuation of application No. 11/573,142, filed as application No. PCT/CA2005/001644 on Oct. 25, 2005, now abandoned.

(60) Provisional application No. 60/621,054, filed on Oct. 25, 2004.

(51) Int. Cl.

| | |
|---|---|
| ***E01C 5/00*** | (2006.01) |
| ***E01C 15/00*** | (2006.01) |
| ***E04F 13/14*** | (2006.01) |
| ***B44F 9/04*** | (2006.01) |
| ***E04F 15/08*** | (2006.01) |

(52) U.S. Cl.
CPC ..... *E01C 15/00* (2013.01); *E04F 13/147* (2013.01); *E04F 15/08* (2013.01); *E01C 2201/02* (2013.01); *E01C 2201/06* (2013.01); *E04F 2201/09* (2013.01)

(58) Field of Classification Search
USPC ..... 404/34–39, 41, 42, 73
See application file for complete search history.

(56) References Cited

U.S. PATENT DOCUMENTS

| | | | |
|---|---|---|---|
| 1,474,779 | A | 11/1923 | Zur Kammer |
| 1,479,647 | A | 1/1924 | Carroll |
| 1,600,787 | A | 9/1926 | Ardit |
| 1,953,657 | A | 4/1934 | Pierce |
| 2,050,299 | A | 8/1936 | Evers |
| D102,144 | S | 12/1936 | Parker |
| 2,605,681 | A | 8/1952 | Thrief |
| 2,606,428 | A | 8/1952 | Oldfather |
| 2,662,343 | A | 12/1953 | Rice |
| 2,893,098 | A | 7/1959 | Tilley |
| 2,991,213 | A | 7/1961 | Williams |
| 3,171,335 | A | 3/1965 | Pincon et al. |
| D204,803 | S | 5/1966 | Leeth |
| 3,267,823 | A | 8/1966 | MacRae |
| 3,386,001 | A | 5/1968 | Slosberg et al. |
| 3,600,773 | A | 8/1971 | Davis et al. |
| D230,478 | S | 2/1974 | Littman et al. |
| D231,926 | S | 6/1974 | Appleton |
| 3,870,423 | A | 3/1975 | Peitz, Jr. |
| 3,903,702 | A | 9/1975 | Appleton |
| 3,947,192 | A | 3/1976 | Rosenberger |
| 4,026,083 | A | 5/1977 | Hoyt et al. |
| 4,078,760 | A | 3/1978 | Mullins |
| 4,105,354 | A | 8/1978 | Bowman |
| 4,125,341 | A | 11/1978 | Reinschutz |
| 4,131,406 | A | 12/1978 | Fresquez |
| 4,135,840 | A | 1/1979 | Puccini et al. |
| 4,217,740 | A | 8/1980 | Assanti |
| 4,231,677 | A | 11/1980 | Roming |
| D257,824 | S | 1/1981 | Puccini et al. |
| D257,825 | S | 1/1981 | Puccini et al. |
| 4,287,141 | A | 9/1981 | Russell |
| 4,313,689 | A | 2/1982 | Reinschutz |
| 4,349,293 | A | 9/1982 | Rosenberger |
| 4,354,773 | A | 10/1982 | Noack |
| 4,407,480 | A | 10/1983 | Trimmer et al. |
| D272,037 | S | 1/1984 | Puccini |
| 4,452,419 | A | 6/1984 | Saleeba |
| 4,510,725 | A | 4/1985 | Wilson |
| 4,544,305 | A | 10/1985 | Hair |
| D281,505 | S | 11/1985 | Larsesn et al. |
| 4,572,699 | A | 2/1986 | Rinninger |
| 4,609,303 | A | 9/1986 | Shumaker |
| 4,627,764 | A | 12/1986 | Scheiwiller |
| D287,884 | S | 1/1987 | Scheiwiller |
| 4,761,095 | A | 8/1988 | Bartlechner |
| 4,773,790 | A | 9/1988 | Hagenah |
| 4,776,723 | A | 10/1988 | Brimo |
| 4,792,257 | A | 12/1988 | Rinninger |
| 4,828,426 | A | 5/1989 | Hendricks et al. |
| 4,834,575 | A | 5/1989 | Barth |
| 4,838,728 | A | 6/1989 | McKeever |
| 4,919,565 | A | 4/1990 | Göpfert |
| 4,921,372 | A | 5/1990 | Hybertson |
| D314,240 | S | 1/1991 | Scheiwiller |
| 4,997,308 | A | 3/1991 | Welling, Jr. |
| 5,051,023 | A | 9/1991 | Yoshida et al. |
| 5,108,219 | A | 4/1992 | Hair |
| 5,133,620 | A | 7/1992 | Scheiwiller |
| 5,201,843 | A | 4/1993 | Hair |
| 5,211,895 | A | 5/1993 | Jacklich, Sr. |
| 5,230,584 | A | 7/1993 | Grossman |
| 5,244,303 | A | 9/1993 | Hair |
| D342,528 | S | 12/1993 | Hupp |
| 5,267,810 | A | 12/1993 | Johnson |
| D343,237 | S | 1/1994 | Johnson, II |
| D343,238 | S | 1/1994 | Hair |
| 5,277,514 | A | 1/1994 | Glickman |
| 5,281,047 | A | 1/1994 | Skaug |
| 5,286,139 | A | 2/1994 | Hair |
| D349,967 | S | 8/1994 | Krueger et al. |
| 5,342,142 | A | 8/1994 | Barth et al. |
| 5,348,417 | A | 9/1994 | Scheiwiller |
| 5,449,245 | A | 9/1995 | Glickman |
| 5,486,066 | A | 1/1996 | Hagenah |
| 5,487,526 | A | 1/1996 | Hupp |
| 5,496,129 | A | 3/1996 | Dube |
| 5,520,388 | A | 5/1996 | Osborn |
| 5,524,396 | A | 6/1996 | Lalvani |
| 5,560,173 | A | 10/1996 | Scheiwill |
| 5,568,391 | A | 10/1996 | Mckee |
| 5,588,775 | A | 12/1996 | Hagenah |
| 5,597,591 | A | 1/1997 | Hagenah |
| 5,619,830 | A | 4/1997 | Osborn |
| 5,625,990 | A | 5/1997 | Hazlett |
| 5,645,369 | A | 7/1997 | Geiger |
| 5,678,370 | A | 10/1997 | Douglass |
| 5,713,155 | A | 2/1998 | Prestele |
| 5,797,698 | A | 8/1998 | Barth et al. |
| D397,802 | S | 9/1998 | Terry |
| D399,978 | S | 10/1998 | Barth et al. |
| D404,147 | S | 1/1999 | Woolford |
| 5,884,445 | A | 3/1999 | Woolford |
| 5,887,846 | A | 3/1999 | Hupp |
| 5,902,069 | A | 5/1999 | Barth et al. |
| 5,921,705 | A | 7/1999 | Hodson et al. |
| 5,941,657 | A | 8/1999 | Banze |
| 5,945,181 | A | 8/1999 | Fisher |
| D424,212 | S | 5/2000 | Abbrancati |
| D426,897 | S | 6/2000 | Abbracati |
| 6,073,411 | A | 6/2000 | Ciccarello |
| D429,343 | S | 8/2000 | Milot |
| D429,530 | S | 8/2000 | Fleishman |
| D431,870 | S | 10/2000 | Ziegler, Jr. |
| D431,871 | S | 10/2000 | Abbrancati |
| 6,168,347 | B1 | 1/2001 | Milot et al. |
| D439,677 | S | 3/2001 | Mattox |
| 6,263,633 | B1 | 7/2001 | Hagenah |
| D452,015 | S | 12/2001 | Aurelius |
| RE37,694 | E | 5/2002 | Riccobene |
| D463,866 | S | 10/2002 | Jang |

(56) References Cited

U.S. PATENT DOCUMENTS

| | | | |
|---|---|---|---|
| 6,471,440 | B1 | 10/2002 | Scheiwiller |
| D471,990 | S | 3/2003 | Riccobene |
| 6,536,988 | B2 | 3/2003 | Geiger |
| D480,819 | S | 10/2003 | Barbier |
| 6,668,484 | B2 | 12/2003 | Riccobene |
| D486,246 | S | 2/2004 | Manthei |
| D488,566 | S | 4/2004 | Fleishman |
| 6,715,956 | B1 | 4/2004 | Weber et al. |
| D492,796 | S | 7/2004 | Price |
| 6,881,463 | B2 | 4/2005 | Riccobene |
| D505,733 | S | 5/2005 | Castonguay et al. |
| D506,013 | S | 6/2005 | Anderson et al. |
| D522,667 | S | 6/2006 | Castonguay et al. |
| D536,058 | S | 1/2007 | Riccobene |
| D537,501 | S | 2/2007 | Riccobene |
| D537,959 | S | 3/2007 | Castonguay et al. |
| D540,954 | S | 4/2007 | Bouchard |
| D541,436 | S | 4/2007 | Wissman |
| D543,642 | S | 5/2007 | Castonguay et al. |
| D550,375 | S | 9/2007 | Thomassen et al. |
| D553,260 | S | 10/2007 | Castonguay et al. |
| D553,759 | S | 10/2007 | Hamel et al. |
| 7,393,155 | B2 | 7/2008 | Riccobene |
| 7,425,106 | B2 | 9/2008 | Altmann et al. |
| D578,658 | S | 10/2008 | Keys |
| D586,925 | S | 2/2009 | Riccobene |
| D590,070 | S | 4/2009 | Castonguay et al. |
| D590,071 | S | 4/2009 | Castonguay et al. |
| D590,072 | S | 4/2009 | Castonguay et al. |
| D602,173 | S | 10/2009 | Thomassen |
| D602,604 | S | 10/2009 | Harris |
| D606,210 | S | 12/2009 | Thomassen |
| 7,637,688 | B2 | 12/2009 | Riccobene |
| 7,674,067 | B2 | 3/2010 | Riccobene |
| D618,364 | S | 6/2010 | Schrom et al. |
| D620,616 | S | 7/2010 | Ciccarello |
| D624,202 | S | 9/2010 | Thomassen et al. |
| D624,203 | S | 9/2010 | Thomassen et al. |
| 7,811,027 | B2 | 10/2010 | Scheiwiller |
| 7,850,393 | B2 | 12/2010 | Hamel |
| D640,800 | S | 6/2011 | Thomassen |
| D643,544 | S | 8/2011 | Thomassen |
| 7,988,382 | B2 | 8/2011 | Castonguay |
| 7,993,718 | B2 | 8/2011 | Riccobene |
| D645,573 | S | 9/2011 | Dallaire et al. |
| D645,574 | S | 9/2011 | Thomassen |
| 8,011,152 | B2 | 9/2011 | Thomassen |
| D646,600 | S | 10/2011 | Minkkinen |
| 8,132,981 | B2 | 3/2012 | Castonguay et al. |
| D660,982 | S | 5/2012 | Thomassen |
| D664,677 | S | 7/2012 | Riccobene |
| 8,226,323 | B2 | 7/2012 | Bouchard et al. |
| 8,282,311 | B2 | 10/2012 | Chow |
| 8,298,641 | B2 | 10/2012 | Riccobene |
| 8,337,116 | B2 | 12/2012 | Castonguay et al. |
| 8,413,397 | B2 | 4/2013 | Lacas et al. |
| 8,500,361 | B2 | 8/2013 | Castonguay et al. |
| D695,915 | S | 12/2013 | Dignard et al. |
| D695,916 | S | 12/2013 | Dignard et al. |
| D695,917 | S | 12/2013 | Dignard et al. |
| D695,918 | S | 12/2013 | Dignard et al. |
| D695,919 | S | 12/2013 | Dignard et al. |
| D695,920 | S | 12/2013 | Dignard |
| D695,921 | S | 12/2013 | Dignard |
| D695,922 | S | 12/2013 | Dignard |
| 8,609,215 | B2 | 12/2013 | Riccobene |
| 8,616,803 | B2 | 12/2013 | Gebhart |
| 8,667,752 | B2 | 3/2014 | Pollack |
| 8,668,404 | B2 | 3/2014 | Bouchard et al. |
| 8,747,019 | B2 | 6/2014 | Castonguay et al. |
| 8,769,896 | B2 | 7/2014 | Lacas et al. |
| 8,967,907 | B2 | 3/2015 | Castonguay et al. |
| 9,057,197 | B2 | 6/2015 | Lacas et al. |
| 9,193,215 | B2 | 11/2015 | Castonguay et al. |
| 9,315,950 | B2 | 4/2016 | Browning et al. |
| 2003/0007834 | A1 | 1/2003 | Bolduc et al. |
| 2004/0163353 | A1 | 8/2004 | Dean |
| 2007/0077387 | A1 | 4/2007 | Riccobene |
| 2007/0217865 | A1 | 9/2007 | Castonguay et al. |
| 2008/0095577 | A1 | 4/2008 | Brun |
| 2008/0101860 | A1 | 5/2008 | Scheiwiller |
| 2008/0209828 | A1 | 9/2008 | Riccobene |
| 2008/0240857 | A1 | 10/2008 | Ciccarello |
| 2009/0097916 | A1 | 4/2009 | Schroder |
| 2010/0162648 | A1 | 7/2010 | Thomassen |
| 2010/0236174 | A1 | 9/2010 | Castonguay et al. |
| 2010/0307092 | A1 | 12/2010 | Bouchard et al. |
| 2011/0067333 | A1 | 3/2011 | Lacas et al. |
| 2011/0293873 | A1 | 12/2011 | Riccobene |
| 2012/0003040 | A1 | 1/2012 | Castonguay et al. |
| 2012/0057933 | A1 | 3/2012 | Gebhart |
| 2012/0189386 | A1 | 7/2012 | Castonguay et al. |
| 2012/0247050 | A1 | 10/2012 | Bouchard et al. |
| 2013/0017016 | A1 | 1/2013 | Castonguay et al. |
| 2013/0259569 | A1 | 10/2013 | Castonguay et al. |
| 2013/0263543 | A1 | 10/2013 | Lacas et al. |
| 2013/0302088 | A1 | 11/2013 | Penshorn |
| 2014/0047788 | A1 | 2/2014 | Riccobene |
| 2014/0112715 | A1 | 4/2014 | Browning et al. |
| 2014/0169878 | A1 | 6/2014 | MacDonald |
| 2014/0205807 | A1 | 7/2014 | Lacas et al. |
| 2014/0241799 | A1 | 8/2014 | Castonguay et al. |
| 2014/0260059 | A1 | 9/2014 | Riccobene et al. |
| 2015/0104588 | A1 | 4/2015 | Castonguay et al. |
| 2015/0176224 | A1 | 6/2015 | Dignard et al. |

FOREIGN PATENT DOCUMENTS

| | | |
|---|---|---|
| CA | 2083215 | 5/1994 |
| CA | 2519296 | 10/2004 |
| CA | 2569998 | 5/2006 |
| CA | 2616200 | 4/2008 |
| CH | 562921 | 6/1975 |
| DE | 7122262 | 11/1971 |
| DE | 3533020 | 3/1987 |
| DE | 9211118 | 3/1993 |
| DE | 4232300 | 3/1994 |
| DE | 4333942 | 4/1995 |
| DE | 19747421 | 4/1999 |
| DE | 19937639 | 2/2000 |
| DE | 29922003 | 2/2000 |
| DE | 10001967 | 7/2001 |
| DE | 20101214 | 5/2002 |
| EP | 0424592 | 5/1991 |
| EP | 666372 A1 | 8/1995 |
| FR | 2354416 | 1/1978 |
| GB | 1094632 | 12/1967 |
| GB | DES. 1047163 | 12/1987 |
| GB | 2208883 | 4/1989 |
| GB | 2214206 | 8/1989 |
| JP | 2002/285504 | 10/2002 |
| JP | 1180760 | 6/2003 |
| JP | 1180761 | 6/2003 |
| JP | 1180860 | 6/2003 |
| JP | 1180861 | 6/2003 |
| JP | 2004-124634 | 4/2004 |
| JP | 3640654 | 1/2005 |
| NL | 7415523 | 6/1976 |
| SE | DES. 44357 | 10/1988 |
| WO | 94/15025 | 7/1994 |
| WO | 0144578 | 6/2001 |
| WO | 01/53612 | 7/2001 |
| WO | 02059423 | 8/2002 |
| WO | 02/89934 | 11/2002 |
| WO | 02/089934 | 11/2002 |
| WO | 02095133 | 11/2002 |
| WO | 2005084900 | 9/2005 |
| WO | 2006045192 | 5/2006 |

(56) References Cited

FOREIGN PATENT DOCUMENTS

| | | |
|---|---|---|
| WO | 2009039617 | 4/2009 |
| WO | 2009140760 | 11/2009 |

OTHER PUBLICATIONS

Fitzgerrell, Basic Masonry Illustrated, a Sunset Book, 1981, pp. 76-77, Lane Publishing Co., Menlo Park, CA, U.S.A.
Bomanite Corp., "Leadership: A Reputation for Excellence, Innovation & Experience", 5 sheets of literature, available at least as early as Oct. 24, 2004.
Brickform Patterns—1 Sheet, 1994.
Brickform Texture Mats—2 Sheets, 1988.
Brickform Tools-Texture Mats—4 Sheets, available at least as early as Oct. 24, 2004, 4 sheets.
Color Tile Advertisement, Royal Rock Ceramic Tile, Jan. 14, 1990, Houston Post, Houston, TX, U.S.A.
Creative Impressions, Ltd., Export Price List and Drawings, Apr. 1990, U.K.
Exhibit G—Photocopy of Front of Color Tile Royal Rock Ceramic Tile, available at least as early as Oct. 24, 2004.
Exhibit H—Photocopy of Rear of Color Tile Royal Rock Ceramic Tile, available at least as early as Oct. 24, 2004.
Decristoforo, Handyman's Guide to Concrete and Masomy, 1978, pp. 183-189, Reston Publishing Co., Inc., Reston, VA, U.S.A.
Decristoforo, Handyman's Guide to Concrete and Masomy Handbook, 1960, p. 70, Arco Publishing Co., Inc., New York City, NY, U.S.A.
Lasting Impressions in Concrete, Inc., available at least as early as Oct. 24, 2004, 6 sheets of literature.
Patterned Concrete Industries, Inc., Specifications, available at least as early as Oct. 24, 2004, 3 sheets.
Sweet's Catalog, vol. 2 Bomacron Patterns, 1994.
Sweets General Building and Renovation, 1993 Catalog File, p. 11, Anchor Buyline 6518, 04200/ANC.
Duncan, The Complete Book of Outdoor Masonry, 1977, pp. 342-345, TAB Books, Blue Ridge Summit, PA, U.S.A.
Uni-Group U.S.A.—Manufacture of Uni Paving Stones the Original. The Best., 1992, Palm Beach Gardens, FL, U.S.A.
Extended European Search Report dated Apr. 18, 2011 in related Application No. 05799111.9.
Written Opinion dated Feb. 2, 2006 in related Application No. PCT/CA2005/001644.
Written Opinion dated Dec. 15, 2008 in related Application No. PCT/CA2008/001656.
Written Opinion dated Sep. 8, 2009 in related Application No. PCT/CA2009/000688.
Grunbaum, B. and Shephard, G.C., "Tilings and Patterns," 1987, pp. 288-290, 510 W.H. Freeman and Company, New York, N.Y.
"Landscapes Become Dreamscapes," Pavestone Company, 2003, 2 pages.
Neolithics Masonry Design, www.neolithicsusa.com, Nov. 2003, 3 pages.
Author: Jinny Beyer, Designing Tessellatins: The Secrets of Interlocking Patterns, Chapter 7: The Keys to creating Interlocking Tessellations: pp. 1-7, 16-17 and 125-165, 1999.
Nature Walk™ Natural Flagstone Appeal for Pedestrian Traffic, 2001, 4 pages.
Website: www.sf-kooperation.de/english/index—Pentalith, Canteon, Jul. 2001, 3 pages.
Website:www.sf-kooperation.de/english/index—Canteon®; CIS 300-10; Pentalith, Sep. 2003, 5 pages.
Retaining Walls, Pavestone Brochure, published 2002, 6 pages.
Concrete Landscaping/Products, Oldcastle Brochure, published 2002, 12 pages.
Website: www.mathforum.org/sum95/suzanne/whattess.html—What is Tessellation?—dated Apr. 24, 2002, 4 pages.
Beautiful Edgers, Pavestone Brochure, published 2002, 5 pages.
Website: www.superstone.com—Split Rock, Dec. 2002, 1 page.
Website: www.matcrete.net/RandomStone.htm—Matcrete the Ultimate in Concrete Design, Dec. 2002, 1 page.
Patio Dreamscapes, Pavestone Brochure; Sandstone System, published 2003, 5 pages.
Landscaping Stones, Mat Stone Brochure, Nature Walk, Garden Walk, published 2003, 2 pages.
Paving Stone Dreamscapes, Pavestone Brochure, published 2003, 13 pages.
Website: www.geckostorte.com—Geckostone™,Mar. 2003, 4 pages.
Website: www.learningcompanyschool.com—TesselMania! Deluxe, Jun. 2003, 3 pages.
Website: riverdeep.net/products/other/tesselmania.jhtml—TesselMania!, Jun. 2003, 4 pages.
European Search Report for 12153381.4-1604/2487295, Sep. 12, 2013.
European Search Report for 12153383.0-1604/2472017, Sep. 11, 2013.
European Search Report for 12153384.8-1604/2487310, Sep. 10, 2013.
European Search Report for 12153380.6-1604/2472016, Sep. 11, 2013.
Brickforrn Patterns—1 Sheet, 1994.
Brickforrn Texture Mats—2 Sheets, 1988.
Brickform Tools—Texture Mats—4 Sheets, available at least as early as Oct. 24, 2004, 4 sheets.
Decristoforo, Handyman's Guide to Concrete and Masonry, 1978, pp. 183-189, Reston Publishing Co., Inc., Reston, VA, U.S.A.
Decristoforo, Handyman's Guide to Concrete and Masonry Handbook, 1960, p. 70, Arco Publishing Co., Inc., New York City, NY, U.S.A.
Website: www.geckostone.com—Geckostone™,Mar. 2003, 4 pages.
Website: www.learningcompanyschool.com —TesselMania! Deluxe, Jun. 2003, 3 pages.
Website: riverdeep.net/products/other/tesselmania.jhtml —TesselMania!, Jun. 2003, 4 pages.

ARTIFICIAL FLAGSTONE FOR PROVIDING A SURFACE WITH A NATURAL RANDOM LOOK

CROSS-REFERENCE TO RELATED APPLICATIONS

This is a continuation application of U.S. patent application Ser. No. 14/577,856 filed Dec. 19, 2014, now allowed, which is a continuation of U.S. patent application Ser. No. 14/272,371, filed May 7, 2014, now issued as U.S. Pat. No. 8,967,907, which is a continuation of U.S. patent application Ser. No. 13/906,116, filed May 30, 2013, now issued as U.S. Pat. No. 8,747,019, which is a continuation of U.S. patent application Ser. No. 13/619,606, filed Sep. 14, 2012, now issued as U.S. Pat. No. 8,500,361, which is a continuation of U.S. patent application Ser. No. 13/367,117, filed Feb. 6, 2012, now issued as U.S. Pat. No. 8,337,116, which is a continuation of U.S. patent application Ser. No. 13/167,053, filed Jun. 23, 2011, now issued as U.S. Pat. No. 8,132,981, which is a continuation of U.S. patent application Ser. No. 12/729,909, filed Mar. 23, 2010, now issued as U.S. Pat. No. 7,988,382, which is a continuation of U.S. patent application Ser. No. 11/573,142, filed Feb. 2, 2007, now abandoned, which is a national phase of PCT Application No. PCT/CA2005/001644, filed Oct. 25, 2005, which claims the benefit of U.S. Provisional Patent Application Ser. No. 60/621,054, filed Oct. 25, 2004, each of which is incorporated in full by reference.

FIELD OF THE INVENTION

The present invention relates generally to the field of artificial stones or flagstones for laying out pavements or for covering a wall surface, and is more particularly directed to such stones giving the resulting pavement or wall surface a natural-looking appearance.

BACKGROUND OF THE INVENTION

It is worth mentioning that the expressions "stone" and "flagstone" are used throughout the present description without distinction to define a flat slab of stone used as a paving or building material. Artificial stones often made of concrete are well-known to lay out pavements or covering wall surfaces on residential or commercial properties, for example defining the surface of walkways or patios. Such stones are advantageously relatively inexpensive to make, as opposed to natural carved flagstones, but the resulting pattern is often repetitive or has what is called in this field an unnatural "linear line effect". Great efforts are therefore being made to design artificial stones which provide a more natural look, creating the effect of old world craftsmanship, while still retaining the ease of their manufacture.

One example of a prior art artificial flagstone is the flagstone marketed under the trademark Kusel-Form. One drawback however with that prior art flagstone, which is provided with regular segments, is that it still does not provide a satisfactory old natural look. It still looks artificial.

Other attempts have been made in the past to develop sets of artificial stones comprising stones of different shapes used in combination with each other for paving a surface. The natural random look in those cases is obtained by combining artificial stones of different shapes. A major drawback however with those sets is that it often becomes a real puzzle for a user to install and combine those stones in a proper way.

Thus, there is still presently a need for an artificial flagstone that provides the real natural random look, long sought after, while at the same time being easy to manufacture at a reasonable cost and easy to install for any unskilled person.

SUMMARY OF THE INVENTION

An object of the present invention is to provide an artificial flagstone that satisfies the above-mentioned need.

In accordance with the present invention, that object is achieved with an artificial flagstone for use in combination with other ones of said artificial flagstones for covering a surface with a natural random look. The flagstone has a generally hexagonal body comprising:

- a first, second, third, fourth, fifth and sixth consecutive vertices;
- a first pair of generally congruent irregularly-shaped first and second sides extending radially from the first vertex and being rotationally spaced from each other by an angle $\alpha$ of approximately 120°;
- a second pair of generally congruent irregularly shaped third and fourth sides extending radially from the third vertex and being rotationally spaced from each other by an angle $\beta$ of approximately 120°;
- a third pair of generally congruent irregularly shaped fifth and sixth sides extending radially from the fifth vertex and being rotationally spaced from each other by an angle $\omega$ of approximately 120°;

wherein the sides of each of the first, second and third pair of sides have at least one split deviation along their length and are respectively rotational images of each other, whereby in use in combination with the other flagstones, each one of the sides is matingly engageable with the sides of an equivalent pair of sides of a neighbouring flagstone.

Advantageously, the present invention makes it possible to obtain a pavement with a real natural random look with no "linear line effect" by simply using a plurality of artificial flagstones having all the same shape. In other words, a single module is sufficient to create a multitude of different designs. There is no need to use different shapes of flagstone to obtain the sought after natural look. Also, the split deviation provided on each side provides an irregular profile that gives the flagstone a more natural look.

The flagstone according to the invention can advantageously be used for creating patio, pathways, sidewalks or stepping stones. Its asymmetrical shape makes the flagstone the ideal material for creating a great variety of designs. With its six irregular sides, the flagstone fits perfectly together, since the flagstone is provided with matingly engageable stone, the end result is extremely stable. Also, for a different look, you can leave wider joints between them and fill the voids with grass.

The present invention is also very advantageous for a manufacturer, since the production of the flagstones requires only a single shape for the mould used for moulding the flagstones.

In accordance with a preferred embodiment, the sides of the second pair of sides are generally congruent to the sides of the third pair of sides.

Also preferably, the fourth and fifth sides, which extend radially from the fourth vertex, are rotationally spaced from each other by an angle $\theta$ of approximately 90°.

Still preferably, the sides of the first pair are approximately half the length of the sides of the second and third pair of sides.

Also preferably, each of the sides has a chiselled upper edge to imitate a Paleolithic stone, and the top face of the stone has a texture that imitates a natural flagstone.

The present invention also concerns a paving covering a surface, the paving comprising a plurality of randomly laid identical flagstones, each of the flagstones being as described hereinabove.

Advantageously, the flagstones of the present invention can easily be laid out to form a pavement or a wall surface where no straight lines and hardly any repetition can be seen, giving as a result, the look of old world craftsmanship.

Further aspects and advantages of the present invention will be better understood upon reading of preferred embodiments thereof with respect to the appended drawings.

DESCRIPTION OF PREFERRED EMBODIMENTS OF THE INVENTION

Figure 1B:
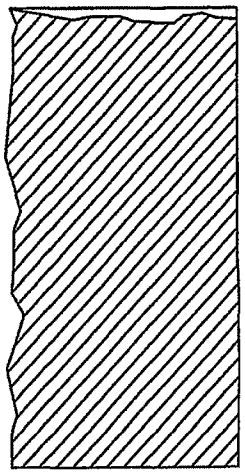
FIGS. 1A and 1B are respectively schematic top and partial side views of an artificial flagstone according to a first preferred embodiment of the invention.

In the following description, similar features in the drawings have been given similar reference numerals and in order to lighten the figures, some elements are not referred to in some figures if they were already identified in a preceding figure.

Referring to either one of FIGS. 1A, 7A, 8A and 9A, the outline of an artificial flagstone 10 according to the invention is illustrated. The illustrated flagstone 10 has a generally hexagonal body with six (6) consecutive vertices 1 to 6 and six (6) sides 12*a* to 12*f*, defining three pairs 12*a*-12*b*, 12*c*-12*d* and 12*e*-12*f* of mutually engageable surfaces. The first and second sides (12*a*-12*b*) extend radially from the first vertex 1 and are rotationally spaced from each other by an angle α of approximately 120°. The third and fourth sides (12*c*-12*d*) extend radially from the third vertex 3 and are rotationally spaced from each other by an angle β of approximately 120°. Finally, the fifth and sixth sides (12*e*-12*f*) extend from the fifth vertex 5 and are rotationally spaced from each other by an angle ω of approximately 120°. It can also be appreciated that the sides of at least one, preferably each, of the first, second and third pair of sides have at least one split deviation 14*b* along their length, and are respectively rotationally images of each other, whereby in use in combination with identical flagstones, each one of the sides is matingly engageable with the sides of an equivalent pair of sides of a neighbouring flagstone, as shown for example in FIGS. 4, 7B, 8B and 9B. In each of the preferred embodiments illustrated, each side comprises a split deviation which divides the sides in three segments, 14*a*, 14*b* and 14*c* projecting outwardly and inwardly with respect to the body of the flagstone.

More particularly, each side has a specific shape along its length which is formed of three end-to-end segments: a first generally straight segment 14*a*, followed by the split deviation 14*b* and a second generally straight segment 14*c*. While conserving this general profile, the sides 12*a* to 12*f* are however slightly irregular, to give the flagstone a more natural looking aspect.

The sides of a given pair have mating profiles, that is the profile of side 12*b* rotated by 120° mates (in other words conforms or fits) with the profile of side 12*a*, and similarly for sides 12*c*-12*d*, and 12*e*-12*f*. In the case of the embodiment shown in FIG. 1A, it will be observed that the sides of each pair respectively project inwardly and outwardly with respect to the body of the flagstone.

Figure 8B:
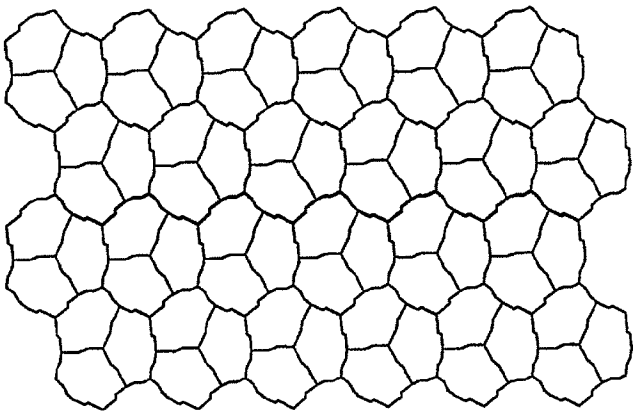
FIG. 8B schematically shows a section of a pavement made of artificial flagstone as shown in FIG. 8A.
Figure 8A:
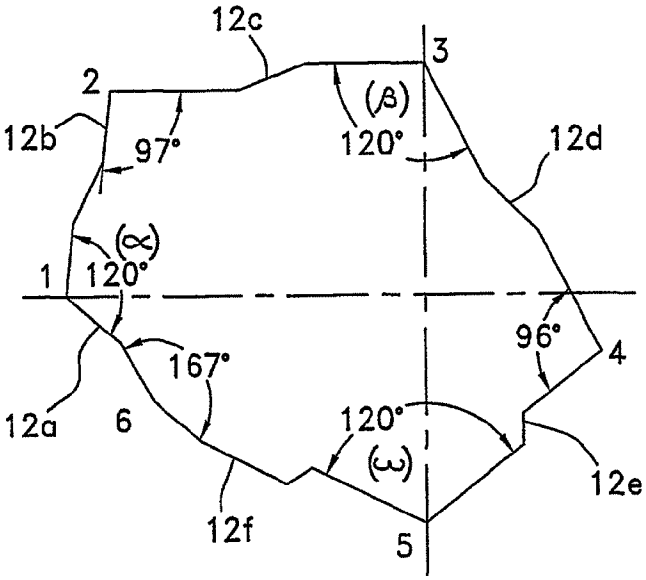
FIG. 8A is a schematic top view of an artificial stone according to a third preferred embodiment of the invention.
Figure 9B:
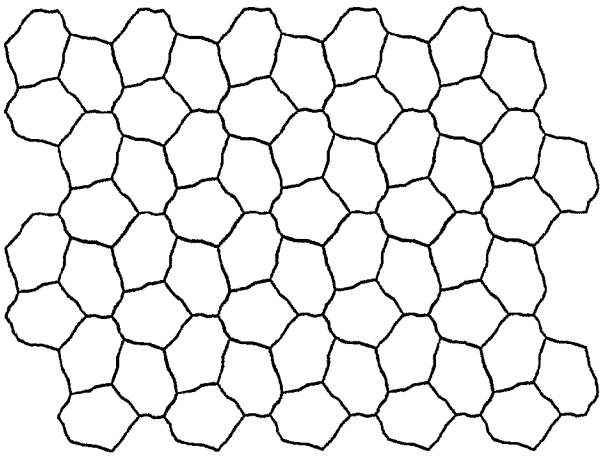
FIG. 9B schematically shows a section of a pavement made of artificial flagstone as shown in FIG. 9A.
Figure 9A:
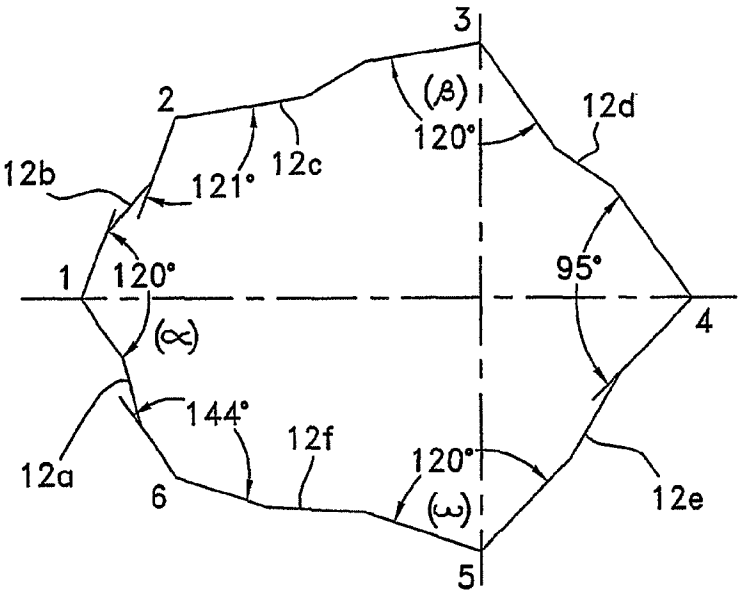
FIG. 9A is a schematic top view of an artificial stone according to a fourth preferred embodiment of the invention.

As can be appreciated, in the first, third and fourth preferred embodiments (FIGS. 1, 8A and 9A, the sides of the second pair of sides (12*c*-12*d*) are generally congruent (same length) to the sides of the third pair of sides (12*e*-12*f*).

It is worth mentioning that the angle between the sides forming the second, fourth and sixth vertices can take numerous values as long as their sum equals 360°. As for example, in the preferred embodiment shown in FIG. 1A, the sides forming the second and sixth vertices, that is to say, sides 12*b* and 12*c* and sides 12*a* and 12*f*, form an angle equal to 135°, whereas the angle separating the sides (12*d*, 12*e*) forming the fourth vertex is equal to 90°.

Figure 7B:
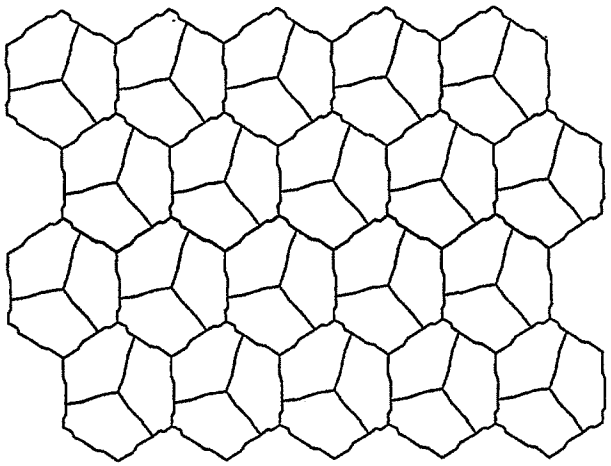
FIG. 7A is a schematic top view of an artificial stone according to a second preferred embodiment of the invention and FIG. 7B schematically shows a section of a pavement made of artificial flagstone as shown in FIG. 7A.
Figure 7A:
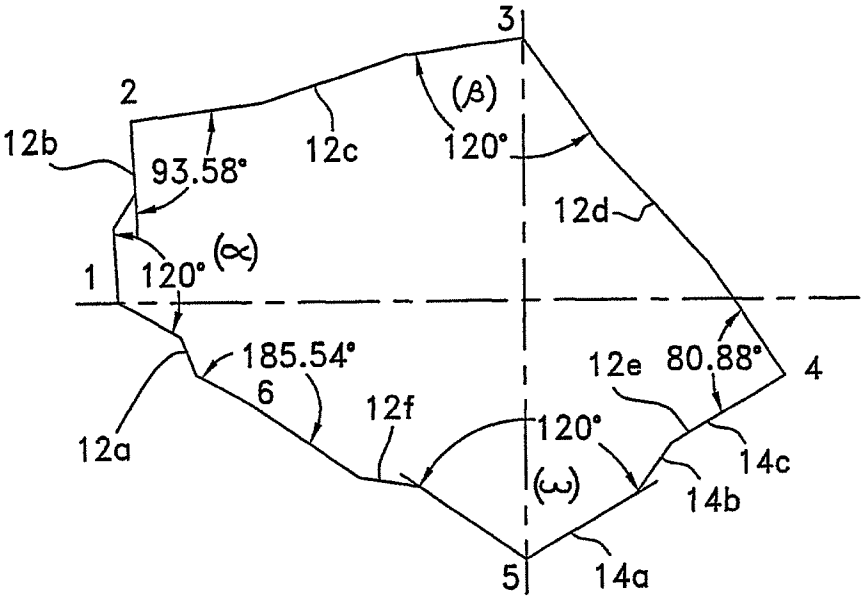

In the preferred embodiment shown in FIG. 7A, the angle between the sides 12*b*-12*c* forming the second apex 2 is equal to 93.58°, the sides 12*d*-12*e* forming the fourth apex 4 form an angle of 80.88° and the angle between the sides 12*f*-12*g* forming the sixth apex 6 is 185.54°. As can be appreciated, the same angles in the preferred embodiments shown in FIGS. 8A and 9A take other values.

Figure 1A:
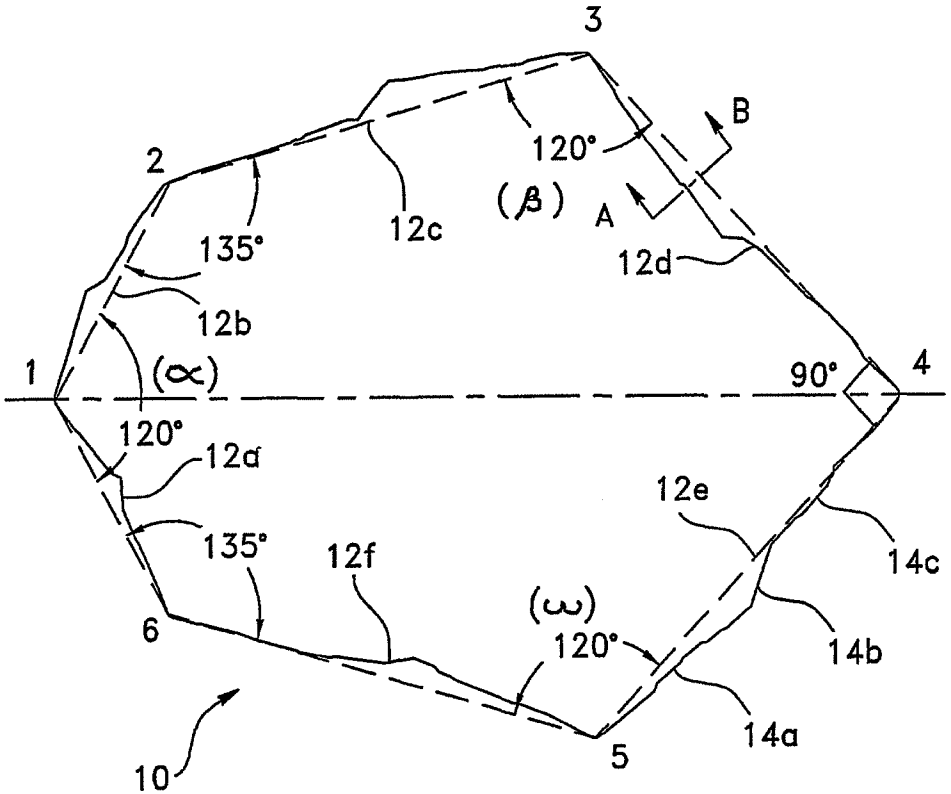

Referring to FIG. 1B, a section of the flagstone of FIG. 1A is shown, where it can be seen that the side walls and top surface thereof are also irregular.

The characteristics of a pavement made of flagstones as described above will now be described with reference to FIGS. 2 to 5, and 7B, 8B, 9B. It will be appreciated that all of the flagstones of a pavement are the same, but still create a visually "random" effect in which no straight lines can be seen. As illustrated more particularly in FIGS. 2A, 2B and 4, each flagstone is laid out relative to the others in one of three orientations A, B, and C. In every case, side 12*a* of one flagstone is adjacent to side 12*b* of another, and the same is true for sides 12*c*-12*d* and 12*e*-12*f*. Spaces of about 2 to 7 mm in width can be seen between adjacent flagstones due to the irregularity of the side edges (see more particularly FIG. 3A).

Figure 5:
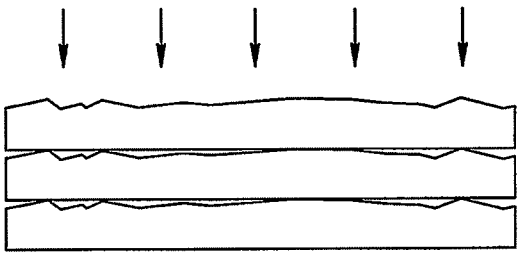
FIG. 5 is a schematic side view of piled up flagstones of different textures according to another aspect of the invention.

Referring to FIG. 5, there are shown possible patterns for the top surface of the artificial stones of the invention. The top surface is preferably given a texture which imitates real flagstones or the like, and the side edges have chiselled upper edges to imitate a Paleolithic stone. Preferably, the top surface of the stones has several regions of the same height, facilitating stacking of the stones.

Figure 6:
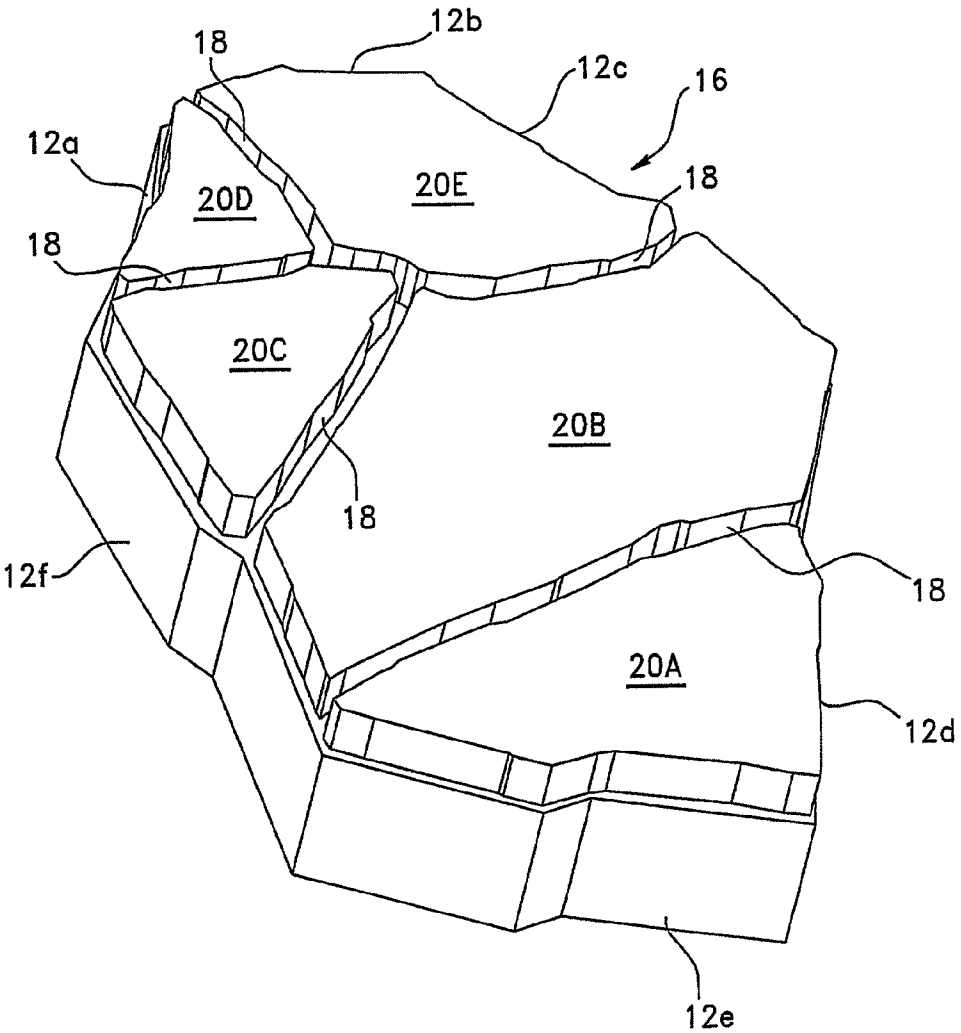
FIG. 6 is a perspective view of a flagstone having a top surface provided with deep joints according to another preferred embodiment of the invention.

Referring to FIG. 6, there is shown an artificial flagstone in accordance with yet another preferred embodiment of the invention. In this embodiment, a flagstone of the profile described above has a top surface 16 provided with deep joints 18 therein. The deep joints 18 preferably extend through a portion of the height of the flagstone, so that when the stone is laid out, it gives the visual impression of an arrangement of smaller stones, while still retaining the advantages of handling only a larger block. In the illustrated embodiment, the deep joints separate the stone into five sections 20A-20E of various shapes and sizes, and are arranged so that they intersect the sides 12*a*-12*f* of the stone either at the joints of two sides or at the sloped segment of a given side. It will be observed from FIG. 6 that with this embodiment, the resulting pavement will seem even more random to the eye. The deep joints 18 may in addition be filled with sand or another filling material, giving an even more natural look to the pavement. The body of the flagstone shown in FIG. 6 is preferably divided into a bottom part 32 devised to contact the surface to cover and an upper part 34 topping the bottom part 32. The upper part 34 has a contour line generally similar to the bottom part 32 and a surface area smaller than the surface area of the bottom part 32 whereby spaces are created between the upper part of adjacent flagstones covering a surface.

In another aspect of this embodiment, the stone may preferably be breakable along the deep joints 18. This allows breaking off one or more of the stone sections 20. Advantageously, as the broken off stone section will still have at least one side following one of the profiles 12*a*-12*f* of the general stone, it will still be possible to matingly engage it with the side of another stone having the matching profile. For example, section 20A having a side 12*e*, it could be laid about the side 12*f* of a similar stone in the same mating engagement described above. This particular embodiment is particularly advantageous to provide a more regular profile at the edge of a pavement, particularly for narrow patterns such as walkways. A side section 20 outwardly projecting at an edge of the walkway may be broken off and used to fill a hole at another portion of the edge or at any appropriate location.

Figure 2A:
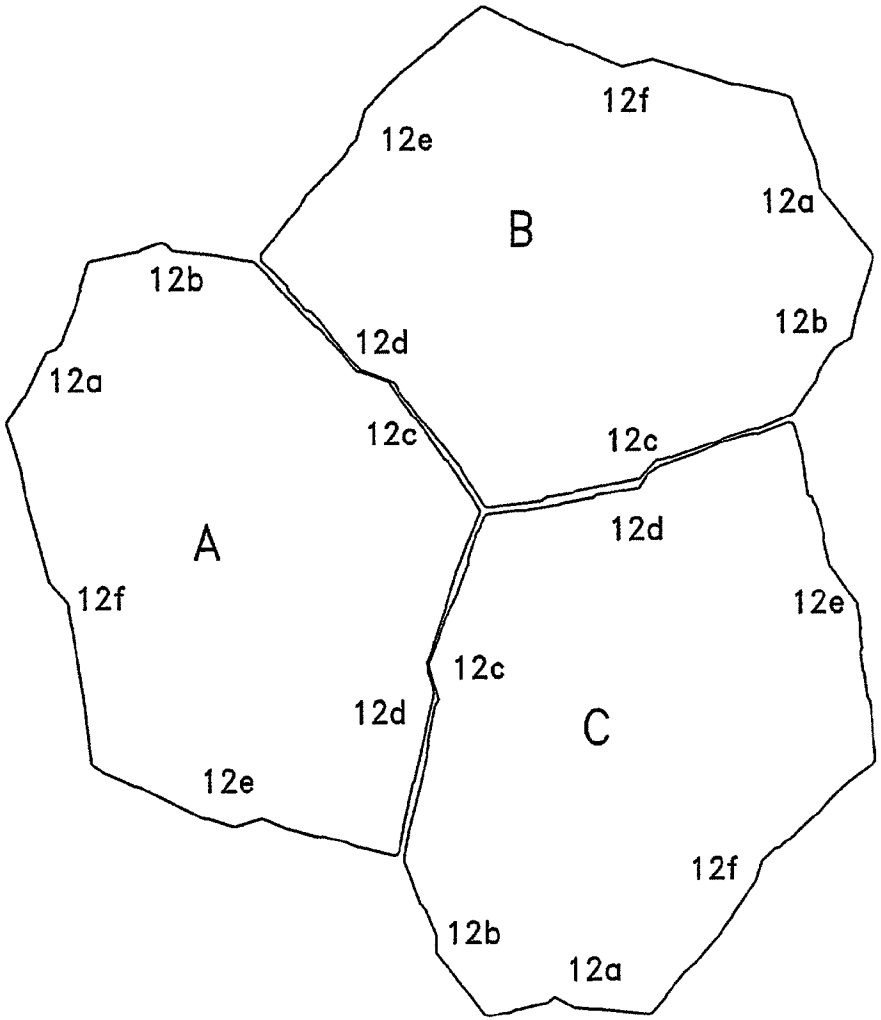
FIGS. 2A and 2B schematically illustrates two possible arrangements showing the three possible relative orientations of the flagstone of FIG. 1A when laid out to form a pavement or for covering a wall surface.
Figure 2C:
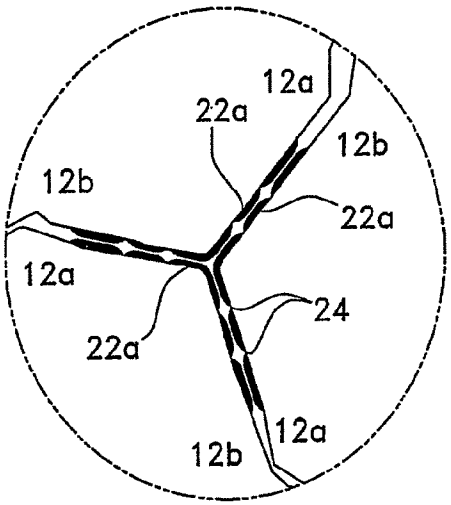
FIG. 2C is an enlargement of zone 2C of FIG. 2A.
Figure 2B:
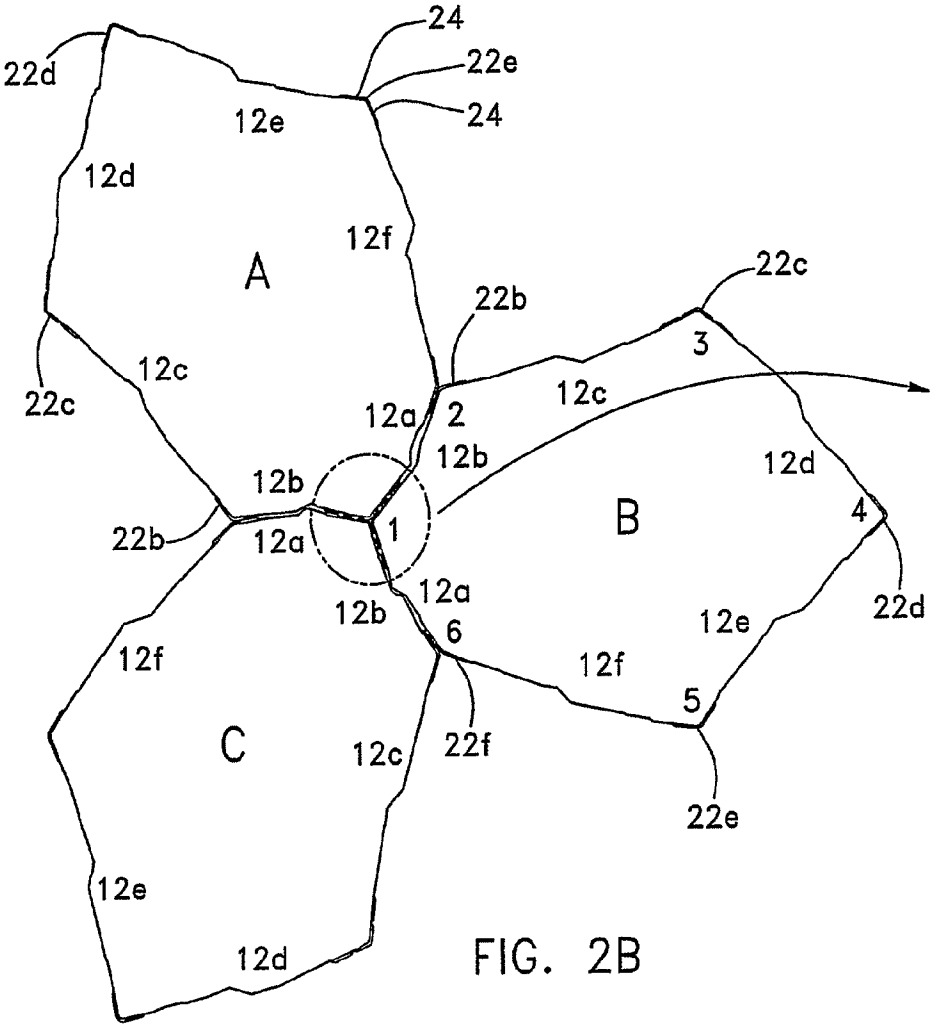
Figure 3:
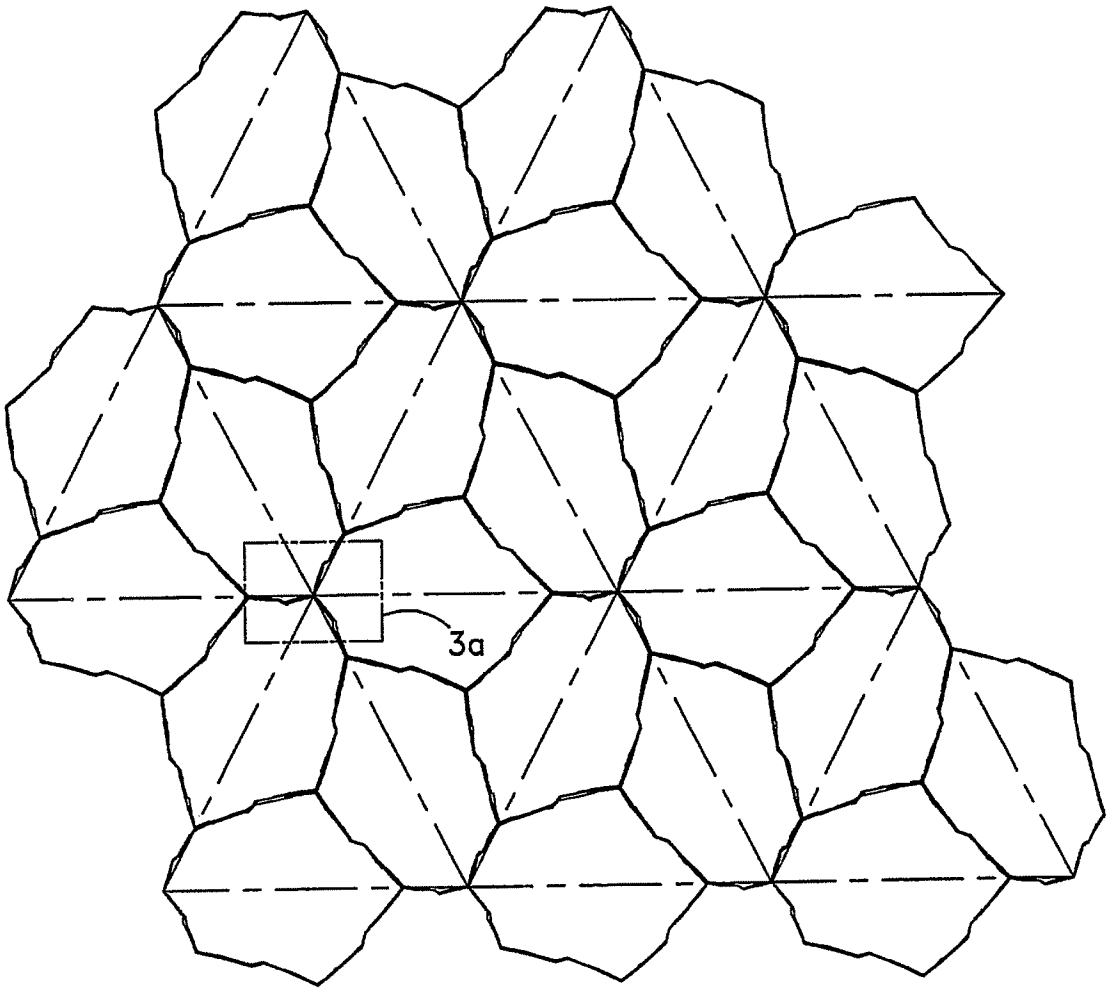
FIG. 3 schematically shows a section of a pavement made of artificial flagstones as shown in FIG. 1A.
Figure 3A:
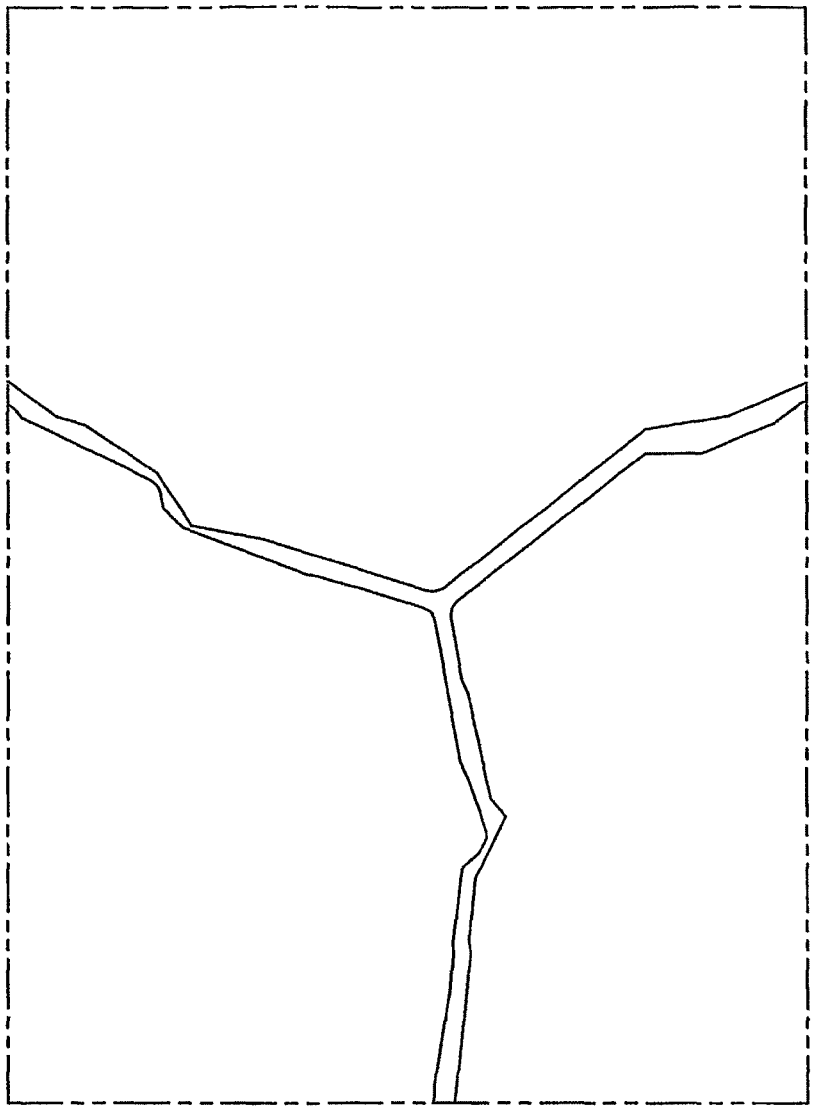
FIG. 3A is an enlargement of zone 3A of FIG. 3.
Figure 4:
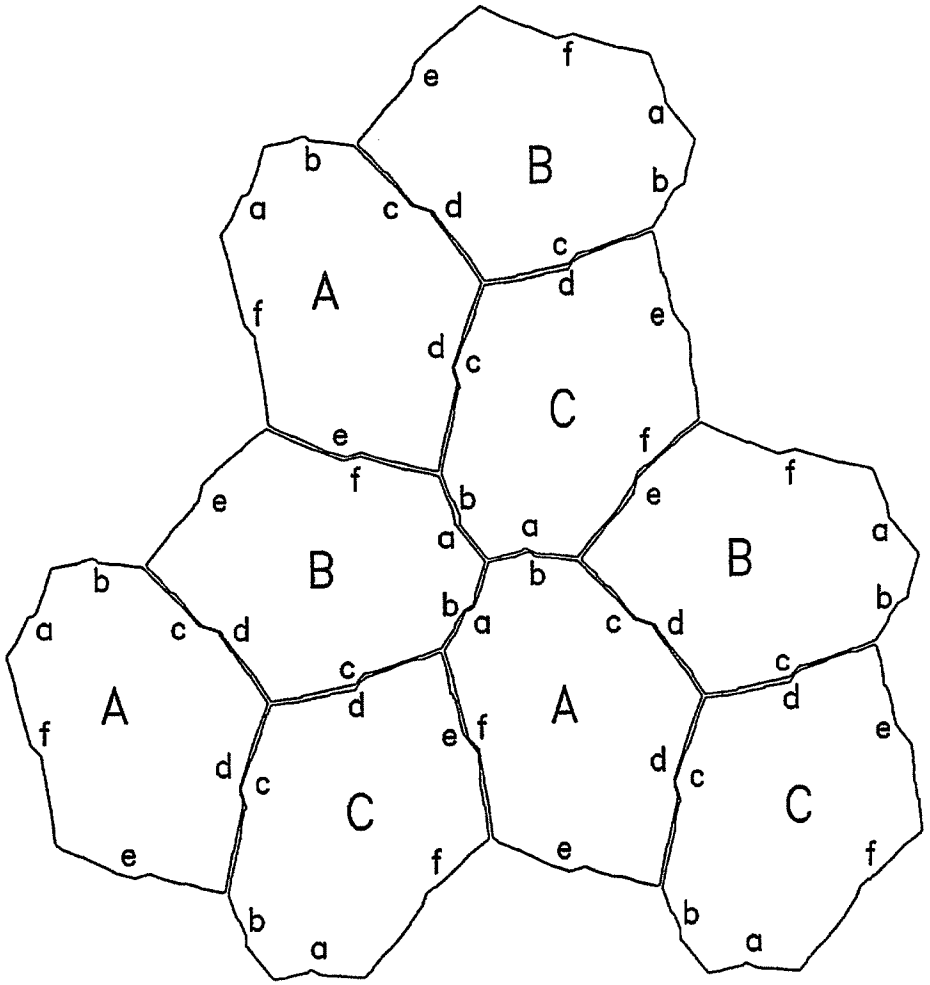
FIG. 4 shows a plurality of laid out flagstones as shown in FIGS. 1A and 1B, identified according to their relative orientation.

Now referring to FIGS. 2A and 2B, there is shown an artificial flagstone in accordance with a still further preferred embodiment of the invention. In this embodiment, the perimeter of the flagstone is identical to any one of the above-described flagstones. It is however preferably provided with distinctive markers (22*a* to 22*f*) used for guiding the laying out of a plurality of flagstones on a surface. More preferably, these distinctive markers (22*a* to 22*f*) are located at the vertices of the flagstone and consist of thin generally plate members protruding from the vertices.

As can be appreciated, the distinctive markers 22*b*, 22*d*, 22*f* located at the second, fourth and sixth vertices 2, 4, 6 are substantially identical to each other, whereas the distinctive markers 22*a*, 22*c*, 22*e* located at the first, third and fifth vertices 1, 3, 5 are different from each other and different from the markers of the second, fourth and sixth vertices.

Even more preferably, the plate-shaped member 22*a* of the first vertex 1 comprises four grooves 24. Two of these grooves are located on the first side 12*a* and the other two grooves 24 are located on the second side 12*b*, whereas the plate-shaped member 22*e* of the fifth vertex 5 comprises two grooves, one on each of the fifth and sixth sides 12*e*-12*f*, respectively.

Therefore, for combining, as for example, a side 12*a* with a side 12*b* of a neighbour flagstone, the user just simply has to guide himself by associating the side with identical markers with each other, as shown in FIG. 2C.

The stone according to the present invention has several advantages over prior art products. Its installation is easy, and does not generally require professional skills. The resulting pavement has no "linear effect", that is, a person walking thereon would not see any straight line in front of him or her. It has a random look, achieved with a single stone design.

The present invention is also advantageous over the prior art since it provides a one piece engageable unit that can cover a surface by simply rotating the one piece unit of 120°, as shown for example in FIGS. 2A and 2B.

Of course, numerous modifications could be made to the embodiments above without departing from the scope of the invention.

The invention claimed is:

1. An artificial flagstone for use in combination with other ones of the artificial flagstone for covering a surface with a natural random look, the flagstone comprising:

a top face comprising a plurality of joints dividing the top face into smaller top sections;

at least first, second, and third consecutive vertices;

a first pair of first and second sides extending radially from the first vertex;

a second pair of third and fourth sides extending radially from the third vertex; and wherein the sides of at least one of the first pair of sides and the second pair of sides are respectively rotational images of each other and have at least one split deviation along their length;

wherein the artificial flagstone has no rotational symmetry when rotated about a central axis.

2. The flagstone as claimed in claim 1, wherein the sides of the first pair of sides are approximately half a length of the sides of the second pair of sides.

3. The flagstone as claimed in claim 1, wherein each of the sides has a chiselled upper edge.

4. The flagstone as claimed in claim 1, wherein the top face comprises a texture that imitates a natural flagstone.

5. The flagstone as claimed in claim 3, wherein the flagstone further comprises a bottom face positioned below the top face, wherein the top face has a contour line generally similar to the bottom face and a surface area smaller than a surface area of the bottom face because of spaces created in the top face by the plurality of joints.

6. The flagstone as claimed in claim 1, wherein the sides of at least one of the first pair of sides and the second pair of sides have at least one split deviation along their length, wherein the at least one split deviation comprises a first generally straight segment, followed by the split deviation and a second generally straight segment.

7. The flagstone as claimed in claim 1, wherein the sides of each of the first pair of sides and the second pair of sides have at least one split deviation along their length.

8. The flagstone as claimed in claim 1, wherein the second side and the third side are rotationally spaced from each other by an angle of approximately 135°.

9. The flagstone as claimed in claim 1, wherein all of the pairs of sides have distinctive markers guiding a lay out of a plurality of the flagstone on a surface.

10. The flagstone as claimed in claim 9, wherein the distinctive markers are located at the vertices.

11. The flagstone as claimed in claim 10, wherein the distinctive markers consist of thin plate-shaped members protruding from the vertices.

* * * * *